US005669786A

United States Patent [19]

Bernardini

[11] Patent Number: 5,669,786

[45] Date of Patent: Sep. 23, 1997

[54] ELECTRICAL TERMINAL FOR HIGH CURRENT APPLICATIONS

[76] Inventor: Allen J. Bernardini, 37 Holly Hill La., Southbury, Conn. 06488

[21] Appl. No.: 623,130

[22] Filed: Mar. 28, 1996

[51] Int. Cl.[6] ..... H01R 4/24

[52] U.S. Cl. ..... 439/424

[58] Field of Search ..... 439/421–424, 439/877–882, 492, 67, 77

[56] References Cited

U.S. PATENT DOCUMENTS

| | | | |
|---|---|---|---|
| 2,884,478 | 4/1959 | Becker et al. | 439/882 |
| 3,064,072 | 11/1962 | Graff et al. | 439/882 |
| 3,541,227 | 11/1970 | Bendrick | 439/827 |
| 3,728,473 | 4/1973 | Kuo | 439/424 |
| 3,784,731 | 1/1974 | Newbold | 439/421 |
| 3,950,064 | 4/1976 | Kuo | 439/421 |
| 4,560,224 | 12/1985 | Weisenberger | 439/422 |

*Primary Examiner*—J. J. Swann
*Attorney, Agent, or Firm*—Michael H. Wallach

[57] ABSTRACT

A mass terminated connector is provided for conducting electrical current. The connector preferably comprises a plurality of U-shaped conductive assemblies and a conductive contact or terminal having a plurality of slots for receiving the conductive assemblies. According to the preferred embodiment, each assembly is manufactured from flat metal stock which is folded into a "U" shape and which includes a series of barbs for penetrating the insulation on the multiple wires of a power cable. The folded metal stock assemblies with connnected wires are received within the associated U-shaped slots in the contact or terminal.

6 Claims, 1 Drawing Sheet

ELECTRICAL TERMINAL FOR HIGH CURRENT APPLICATIONS

FIELD OF THE INVENTION

This invention relates in general to electrical connectors, and more particularly to the mass termination of a multiplicity of wires to a single point for the purpose of handling high current in an electrical connector.

BACKGROUND OF THE INVENTION

A common problem in high current applications such as battery charging and DC power distribution, is the termination of high current carrying conductors to a connector. For such high current applications, the conductors often comprise a plurality of wires rather than a single high current carrying cable (e.g. 16 number 14AWG twisted pair wires with an overall shield).

According to the prior art, the multiple wires which comprise a power conductor are soldered, crimped or welded to the connector after the insulation has been physically stripped from the individual wires. This technique is extremely labour and time intensive.

SUMMARY OF THE INVENTION

According to one aspect of the present invention, a mass terminated connector is provided for conducting high current. The connector as exemplified by a preferred embodiment of the invention, comprises one or more connector contacts for receiving a plurality of U-shaped conductive assemblies. Each connector contact or terminal comprises a plurality of slots for receiving the conductive assemblies. According to the preferred embodiment, each assembly is manufactured from flat metal stock which is folded into a "U" shape and which includes a series of barbs for penetrating the insulation on the multiple wires of the power cable. The folded metal stock assemblies with connected wires are received within the associated U-shaped slots in the connector body.

BRIEF DESCRIPTION OF THE DRAWINGS

A detailed description of the preferred embodiment is provided herein below with reference to the following drawings, in which.

DETAILED DESCRIPTION OF THE PREFERRED EMBODIMENT

Figure 1:
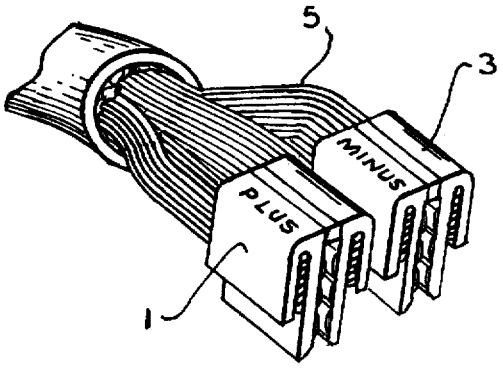
FIG. 1 is a perspective view of a pair of connectors in accordance with the preferred embodiment shown connected to a high current carrying multiple wire cable.

FIG. 1 shows plus (+) and minus (–) connectors 1 and 3, each in accordance with the present invention, terminating the wire ends of a power cable 5. A cross sectional view is provided in FIG. 2. In the illustrated preferred embodiment, each connector comprises a pair of U-shaped conductive assemblies 7 and 9 which are received within respective U-shaped slots 11 and 13, of a contact or terminal 15, as shown best in FIGS. 2 and 7.

Figure 3:
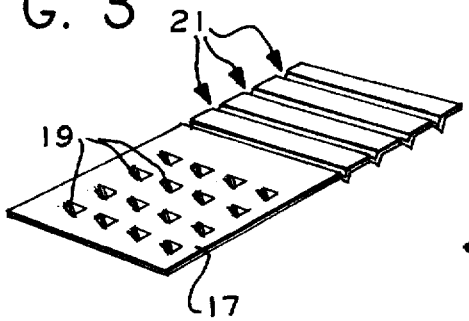
FIG. 3 is a perspective view of a piece of flat metal stock which has been punched and formed to provide barbs on one half and V-shaped grooves on the other half.
Figure 4:
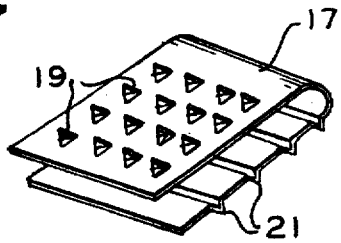
FIG. 4 shows the stock of FIG. 3 folded so as to form a U-shaped conductive assembly with the protruding barbs lined up internally of the folded stock with the V-shaped grooves.

According to the preferred embodiment, each assembly 7 and 9 is fabricated from a piece of flat, highly conductive and ductile metal stock 17 (FIG. 3). The metal stock 17 is preferably punched and formed to create a plurality of barbs 19 on one half and V-shaped grooves 21 on the other half. FIG. 4 shows the stock 17 folded over such that the protruding barbs 19 are lined up internally with respective ones of the V-shaped grooves 21.

Figure 5:
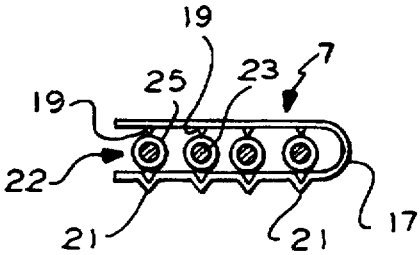
FIG. 5 is an end view of the U-shaped assembly with individual wires of the multiple wire cable laying in the V-shaped grooves, and the orientation of the barbs above the individual wires.
Figure 6:
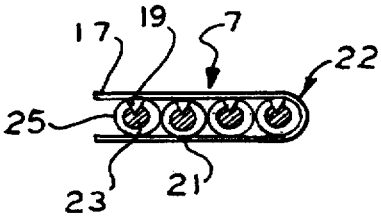
FIG. 6 is an end view similar to FIG. 5 after the assembly has been compressed such that the barbs pierce the wire insulation and embed themselves into the conductors.

In FIG. 5, the individual cable wires 22 are shown laying in respective ones of the V-shaped grooves 21 (each wire 22 consisting of a central conductor 23 surrounded by insulation 25). As shown in FIG. 5, the insulation 25 is not stripped prior to being laid in the V-shaped grooves 21.

The assembly 7 (and 9) is then mechanically compressed such that the barbs 19 pierce the insulation 25 of each wire 22 and are embedded in the respective central conductors 23, thereby providing good electrical connection and mechanical retention of the wires 22.

Figure 2:
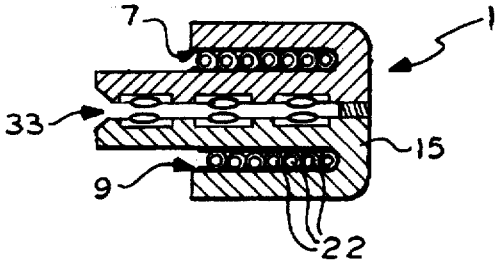
FIG. 2 is a vertical cross section through a connector contact or terminal of one of the connectors shown in FIG. 1.
Figure 7:
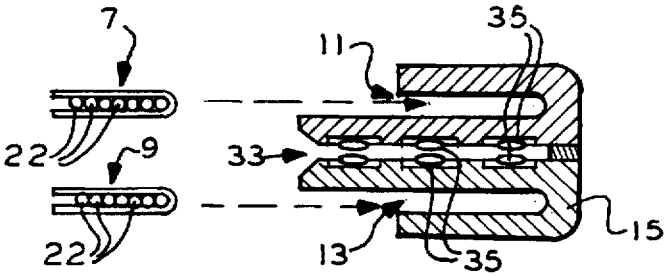
FIG. 7 is a vertical cross section similar to FIG. 2, showing two assemblies prior to being force fit into a connector contact.

As discussed briefly above, FIG. 7 shows the assemblies 7 and 9 prior to being force fit into the U-shaped slots 11 and 13, respectively, of the contact terminal 15, while FIG. 2 shows the completed connector 1. Force fitting of the assemblies 7 and 9 into slots 11 and 13 can be effected using a mechanical tool, in a well known manner, and results in a good electrical as well as mechanical connection.

According to the invention, the wires 22 need not be cut to length prior to installation in the assembly 7 (or 9), but can be gang sheared after termination.

A person understanding the principles of the present invention may conceive of alternative embodiments or variations thereof. For example, the flat metal stock 17 can be selected from a number of suitable conductive materials capable of being stamped and formed. The number of barbs 19 per V-shaped groove 21 depends on the required conductivity, although at least one barb must be provided per groove. The number of rows of grooves 21 (and barbs 19) is related to the number of wires 22 to be terminated. In FIGS. 1, 2 and 7, each connector is shown with eight such rows of barbs 19 and grooves 21 for receiving eight wires 22, while the illustrative example of the assembly shown in FIGS. 3 to 6 shows four such rows of barbs 19 and grooves 21 for receiving four wires 22. Furthermore, it is contemplated that the grooves 21 can be U-shaped or any other suitable shape for receiving the wires 22. Indeed, it is also contemplated that where a suitably ductile metal is used for the flat metal stock 17, it may be possible to omit preforming of the grooves 21 altogether. Instead, according to this embodiment, the metal stock 17 is punched to form barbs 19, folded over such that the barbs 19 line up with the wires 22, and then compressed so that the barbs 19 pierce the insulation of the wires and the ductile metal stock 17 forms around the wires 22 (i.e. "packing" the wires 22 against the metal stock 17). In fact, the material 17 (less barbs and grooves), can be folded and compressed so that all wires 22 lay in parallel and the creation of barbs 19 and subsequent piercing of the wires 22 by the barbs 19 can be effected via a separate punching operation. All such embodiments and variations are believed to be within the sphere and scope of the invention as set forth in the claims appended hereto.

I claim:

1. A mass terminated connector for multiple wire cables, each wire having a central conductor surrounded by an insulator, comprising:

a) at least one U-shaped conductive assembly for receiving said multiple wire cable, a plurality of barbs arranged on one half of said assembly such that at least one of said plurality of barbs is aligned with an associated wire for piercing said insulator and penetrating said central conductor of each said wire, said U-shaped conductive assembly being further comprised of a plurality of grooves arranged in rows on an opposite half of said assembly from said plurality of barbs for receiving individual ones of said wires, said U-shaped conductive assembly being fabricated from flat metal stock which is punched and formed to create said barbs and grooves, and folded over for alignment of said barbs and said grooves, said plurality of barbs arranged in rows and columns such that more than one barb is aligned with each of said grooves; and b) a conductive contact having at least one U-shaped slot for receiving said at least one U-shaped conductive assembly.

2. The mass terminated connector of claim 1, wherein said grooves are V-shaped.

3. The mass terminated connector of claim 1, wherein said grooves are U-shaped.

4. A conductive assembly for terminating multiple wire cables, each wire having a central conductor surrounded by an insulator, comprising:

a) a piece of flat metal stock folded into a U-shape;

b) a plurality of barbs arranged on one half of said flat metal stock such that at least one of said plurality of barbs is aligned with an associated wire for piercing said insulator and penetrating said central conductor of each said wire; and c) a plurality of grooves arranged in rows on an opposite half of said flat metal stock to said plurality of barbs for receiving individual ones of said wires, said plurality of barbs on said conductive assembly being arranged in rows and columns such that more than one barb is aligned with each of said grooves.

5. The conductive assembly of claim 4, wherein said grooves are V-shaped.

6. The conductive assembly of claim 4, wherein said grooves are U-shaped.

* * * * *